United States Patent [19]

Jennings

[11] 4,309,958

[45] Jan. 12, 1982

[54] COATING LANCE CENTRALIZER

[75] Inventor: Charles E. Jennings, Houston, Tex.

[73] Assignee: PA Incorporated, Houston, Tex.

[21] Appl. No.: 160,044

[22] Filed: Jun. 16, 1980

[51] Int. Cl.[3] ..... B05C 7/02

[52] U.S. Cl. ..... 118/306; 118/DIG. 10

[58] Field of Search ..... 118/105, 306, DIG. 10; 134/22 C, 166 C, 167 C, 168 C, 169 C; 15/104.05, 104.3 R, 104.19

[56] References Cited

U.S. PATENT DOCUMENTS

| | | | |
|---|---|---|---|
| 2,278,026 | 3/1942 | Smith | 15/104.3 R |
| 2,461,517 | 2/1949 | Carnevale | 118/306 |
| 2,800,875 | 7/1957 | Jewell | 118/306 |
| 3,570,503 | 3/1971 | Deboliac | 134/168 R |

*Primary Examiner*—John P. McIntosh

*Attorney, Agent, or Firm*—William C. Norvell, Jr.

[57] ABSTRACT

An improved apparatus for maintaining the lance portion of a coating device accurately centered within the bore of a tubular conduit to be coated as the lance is moved axially through such bore. The tubular element of such coating lance is supported by a saddle which in turn is supported between two elongated skids which are respectively engageable with opposed top and bottom surfaces of the conduit bore. Radially projecting pins are respectively provided on each side of the saddle. Two pairs of expanding links are respectively pivotally mounted on each end of the saddle pins in an X configuration and one end of each link is pivotally connected to a pivot mounting bracket formed on one of the skids. The other ends of the expanding links are slidably engaged with the internal surfaces of the mounting brackets so that the expanding links may be moved from an essentially horizontal position, wherein the skids are collapsed adjacent to the lance supporting tubing, to a more upright position wherein the skids are radially expanded relative to the supporting tubing. Expansion and contraction of the links is respectively accomplished by actuating elements secured to the tubular portion of the lance in axially spaced relationship relative to the common pivot points of the expanding links. One such link actuator causes the links to collapse when the lance supporting tube is moved in one direction and the other link actuator causes the supporting links to pivot to their expanded position when the lance supporting tubing is moved in the opposite direction.

7 Claims, 12 Drawing Figures

COATING LANCE CENTRALIZER

BACKGROUND OF THE INVENTION

1. Field of the Invention

This invention relates to a centralizing support mechanism for the tubing portion of a coating lance to cooperate with the interior bore of a conduit to be coated by axial movement of the coating lance through such conduit.

2. Description of the Prior Art

It has been common practice in the coating of drill pipe for oil, gas or water wells and similar conduits to effect the coating by pulling through the pipe a coating lance, comprising a fluid slinging disc driven by an air motor and mounted on the end of a tube which functions not only to support the coating lance and move it through the bore of the pipe, but also to supply pressured fluid for coating and air to drive the fluid operated motor. Coating fluid is radially discharged by the slinging disc to form a uniform coating on the interior walls of the pipe as the coating lance is moved axially through the pipe.

Obviously, the consistency of the depth of coating applied to the interior pipe surface is a function of the location of the axis of the rotating sling relative to the axis of the interior pipe bore. Prior art devices have utilized centralizers in the form of wooden support skids which rested on and slid along the bottom surface of the pipe bore surface to be coated. This apparatus has not proven to be reliable in that the skid is subject to bouncing and tends to move within the pipe to one side or the other of the tubing bore and thus vary the alignment of the sling axis with the axis of the pipe bore. Furthermore, it is well known that each length of pipe has definite variations in internal bore diameter and the prior art centralizing device did not provide any mechanism for compensating for such variations.

There is, therefore, a need for a centralizing device for insuring that a coating lance will accurately maintain its coaxial alignment with the bore of a pipe to be coated as the lance is pulled through such pipe.

SUMMARY OF THE INVENTION

The invention provides an improved centralizing mechanism for a coating lance to achieve the accurate alignment of the axis of such coating lance with the axis of the bore of a length of pipe to be coated as the lance is moved axially through such bore. A conventional sling and air motor are mounted on a length of tubing greater than the length of the pipe bore to be coated and are passed through the pipe bore by such tubing. At a point axially adjacent to the air motor, a pair of arcuate skids are mounted to the tubular support by two pairs of X-shaped supporting links with each pair of links being centrally pivotally mounted on a pivot pin projecting radially from an open top saddle in which the tubular support rests. One end of each of the links is pivotally mounted to a bracket which is rigidly secured to the internal surface of the skids while the other end is free to slide along an internal surface of such brackets. The X-shaped supporting links are thus movable between an essentially horizontal closed position wherein the skids are collapsed against the supporting tubing to an expanded position wherein the links are more upright and the skids are radially expanded to engage the internal bore surface of the pipe to be coated.

Actuation of the supporting links is achieved by a pair of actuating brackets which are secured to the lance supporting tubing in axially spaced relationship and on opposite sides of the supporting links. When the supporting tubing is initially moved through the bore of the pipe to be coated, the one actuating bracket engages the saddle supporting the links and causes the links to assume their collapsed position, thus retracting the skids and permitting the free passage of the centralizing mechanism through the bore of the pipe to be coated. Upon reversal of the movement of the support tubing to pull the coating lance back through the pipe bore and apply a coating thereto, a projection on the second actuating bracket engages the supporting links and moves them to their more upright position, thus expanding the skids to snugly engage the interior bore surface of the pipe to be coated.

To assist in the expansion movement of the skids, a compressed spring may be attached to one of the sliding ends of each pair of supporting links. Means are provided for adjusting the force exerted by such compressed spring to compensate for different weights of air motors and coating slings or different axial locations of such mechanisms relative to the centralizing apparatus.

DECRIPTION OF THE PREFERRED EMBODIMENTS

Figure 1:
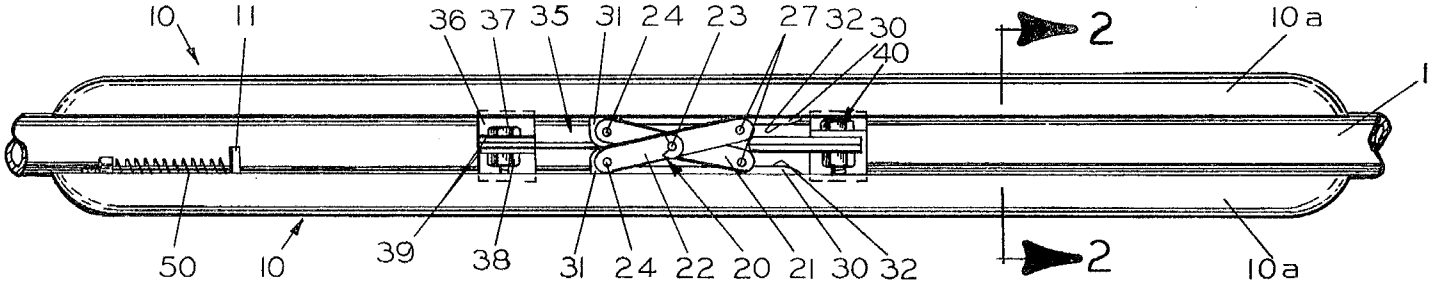
FIG. 1 is a side elevational view of a coating lance centralizing mechanism embodying this invention with the locating skids shown in their collapsed position.

Referring to FIGS. 1 through 4, a centralizing mechanism for a coating lance comprises a pair of identical elongated skids 10 having an arcuate cross section, with the external surfaces 10*a* thereof contoured to slidably engage the interior bore of a pipe. The interior arcuate surfaces 10*b* of skids 10 are contoured to surround the hollow tubular portion 1 of a conventional coating lance. The air operated motor and the rotating paint sling conventionally provided on such coating lance forms no part of this invention and hence are not shown in the drawings. In customary practice, these elements of the coating lance are normally mounted approximately one to two feet axially away from the end of the skids 10 so that when the lance is inserted through the entire bore of a length of pipe, the paint sling will be located outside the pipe, the air motor may be energized, and the paint sling rotated to initiate a centrifugal flow of paint before the sling enters the interior bore of the length of pipe to be coated by reverse axial movement of the lance.

Figure 8:
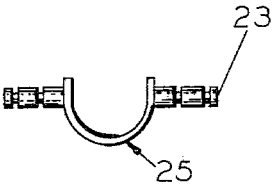
FIG. 8 is an end elevational view of the saddle element which supports the lance tubing and provides the pivotal mounting for the expansion links.

The support skids 10 are interconnected by two horizontally spaced X-shaped expansion linkages 20, each comprising a pair of identical links 21 and 22 which are medially pivoted on a pin 23. Pins 23 in turn are formed in laterally projecting radial relationship on the sides of a semi-circular saddle element 25 (FIG. 8) which provides support for the tubing element 1 of the coating lance.

Figure 2:
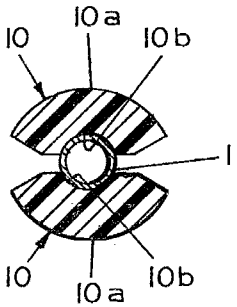
FIG. 2 is a sectional view taken on the plane 2—2 of FIG. 1.
Figure 4:
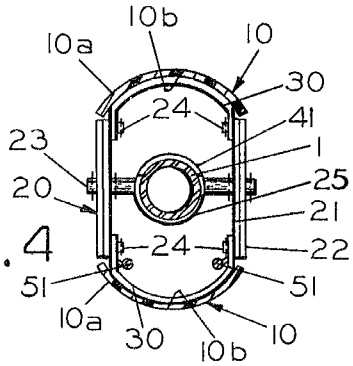
FIG. 4 is a sectional view taken on the plane 4—4 of FIG. 3.

The skids 10 are shown in FIG. 2 as being solid, but it will be appreciated that they may be hollow or shell-like.

Figure 6:
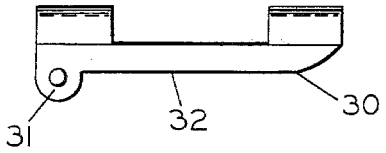
FIG. 6 is a side elevational view of one of the expansion link mounting brackets.
Figure 7:
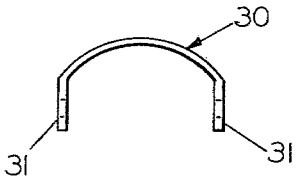
FIG. 7 is an end view of the bracket shown in FIG. 6.

To connect the skids 10 to the X-shaped expansion linkages 20, a pair of brackets 30 are respectively rigidly secured to the inner surfaces 10*b* of the skids 10. While the skids may be made of any relatively soft rigid material which will not scratch the bore surface of the pipe to be coated, it is preferred that the skids 10 be fabricated from fiberglass impregnated plastic, in which case the brackets 30 may be fabricated from metal and either adhesively secured to skids 10 or integrally bonded thereto in the process of fabricating the skids 10. Each bracket 30 (FIGS. 6 and 7) is provided at one end with a pair of laterally spaced, inwardly projecting lugs 31 which are respectively apertured to pivotally receive pins 24 respectively provided in the upper end of link 21 and in the lower end of link 22 of each of the X-shaped linkages 20. Sliding pins 27 are respectively provided in the upper end of each link 22 and in the lower end of each link 21 of the X-shaped linkages 20 and pins 27 slidably engage an axially extending flat surface 32 provided on the lateral edge of each mounting bracket 30.

It is therefore apparent that the relative pivotal movement of the links 21 and 22 of the pair of X-shaped linkages 20, determines the vertical position of the skids 10 relative to the saddle 25, hence relative to the tubular element 1 of the coating lance. Because each link 21 and 22 has one end mounted for free axial sliding movement, it is apparent that the X-shaped linkages 20 may be shifted from a relatively closed, substantially horizontal position illustrated in FIG. 1 to a more upright expanded position shown in FIG. 3 and that correspondingly, the skids 10 will be moved from a position closely adjacent to the tubular element 1 of the coating lance to an expanded position wherein the outer surfaces 10*a* of the skids 10 are in engagement with the internal bore of a length of pipe to be coated.

Figure 11:
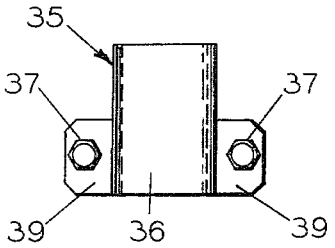
FIG. 11 is a plan view of the closing actuating bracket.
Figure 12:
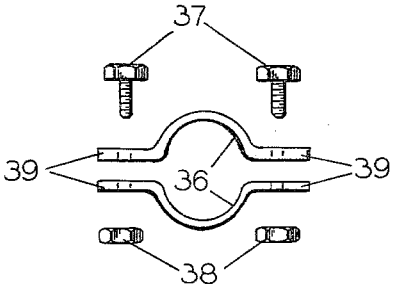
FIG. 12 is an exploded elevational view of the bracket shown in FIG. 11.

The shifting of the X-shaped linkages is accomplished in accordance with this invention by a pair of actuating brackets 35 and 40 which are respectively clamped onto the tubular element 1 on opposite sides of the X-shaped linkage 20. Bracket 35, which will hereinafter referred to as the closing bracket is disposed on the side of the X-shaped linkage 20 opposite to the location of the air motor and coating sling. In other words, when the tubular element 1 of the coating lance is moved to the right as viewed in FIGS. 1 and 3, the bracket 35 will be moved into engagement with the saddle 25 and effect the collapsing of the X-shaped linkages to the position illustrated in FIG. 1 so that the skids 10 will move freely through the bore of the pipe to be coated. As best shown in FIGS. 11 and 12, the closing actuating bracket 35 comprises two identical semi-cylindrical elements 36 which are secured in clamping relationship to the tubular element 1 by a pair of bolts 37, which pass through radially projecting flanges 39 integrally formed on the semi-cylindrical brackets 36, and cooperating nuts 38.

Figure 3:
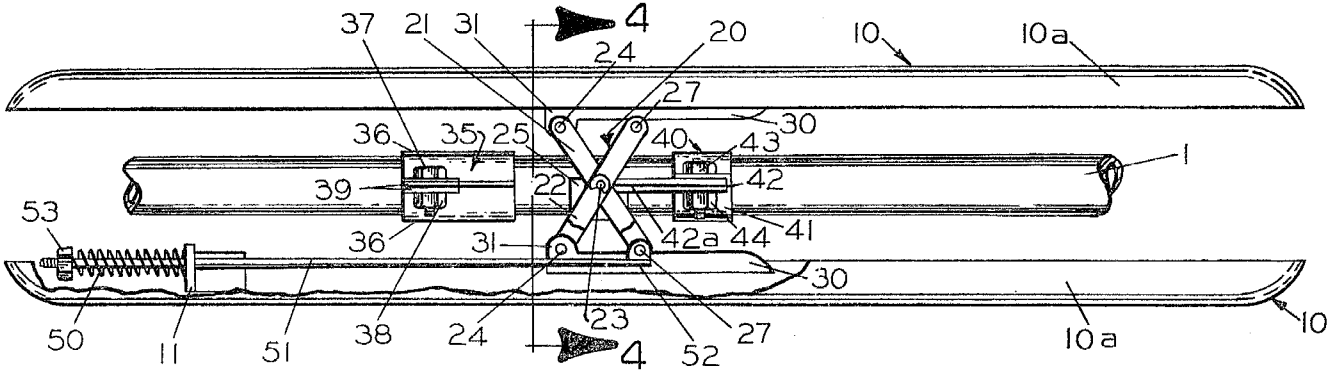
FIG. 3 is a view similar to FIG. 1, but partly in section, and showing the locating skids disposed in their expanded position.
Figure 9:
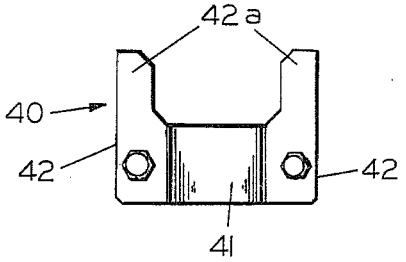
FIG. 9 is a plan view of the expansion actuating bracket.
Figure 10:
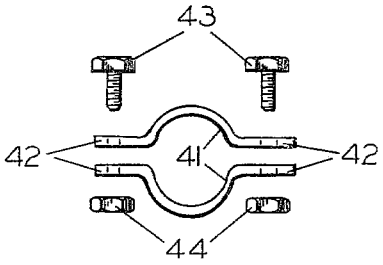
FIG. 10 is an exploded elevational view of the bracket shown in FIG. 9.

Referring now to FIGS. 9 and 10, the expansion actuating bracket 40 comprises a pair of identical semi-cylindrical clamping elements 41 having radial flanges 42 formed on each side thereof and apertured to receive clamping bolts 43 which are secured thereto by nuts 44. The radially projecting flanges 42 project axially toward the X-shaped linkages 20 and, in fact, are proportioned so as to slide between the links 21 and 22. Thus, as illustrated in FIG. 3, when the tubular element 1 of the coating lance is moved to the left, as illustrated in FIG. 3, the axial projections 42*a* respectively engage the links 21 and 22 of each X-shaped linkage and shift such links to their upright or open position and thus produce an expansion movement of the skids 10 into sliding engagement with the bore of the pipe to be coated.

To minimize the force required to effect the expansion of the skids 10 by the axial movement of the tubular element in the coating direction, a biasing force may be imparted to each of the X-shaped linkages by a compressed spring 50. Spring 50 is mounted on the end of a rod 51 which passes through a bracket 11 which is integrally molded into the fiberglass skids 10 and apertured to permit the rod 51 to freely slide therethrough. The other end of rod 51 is formed as a pivot bracket 52 and is pivotally secured to the sliding pivot pins 27 provided in the bottom end of each of the links 21 (FIG. 3). Each spring 50 is compressed between the bracket 11 and a nut 53 which is secured to the threaded end of the rod 51. Hence the amount of biasing force may be readily adjusted by changing the axial position of the nuts 53 on the threaded end of the rod 51. It should be particularly noticed that while the spring biased rods 51 impart a biasing force to each of the X-shaped expansion linkages 20, they do not otherwise interfere with the free sliding movement of the slide pins 27 relative to the flat skid surfaces 32 provided on the brackets 30.

The described construction has the further advantage that the skids 10 will automatically adjust the conform to any variations in internal diameter of the bore of the pipe to be coated. In fact, as is well known, a drill pipe commonly has a reduced constriction adjacent each end thereof.

Figure 5:
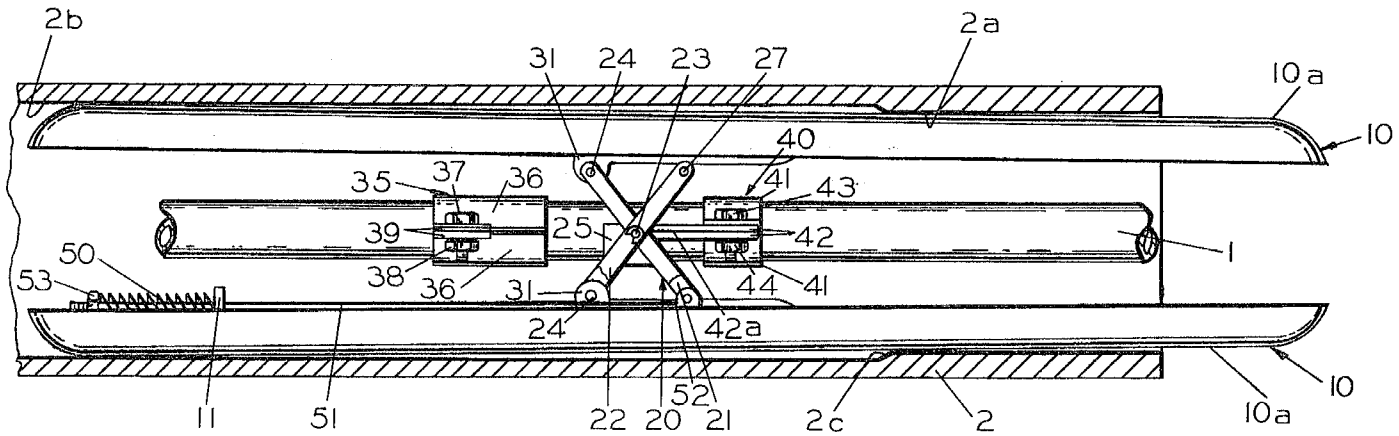
FIG. 5 is a sectional view of a pipe bore having an expanded centralizing device positioned therein, and illustrating the adjustment of the centralizing device to a change in diameter of the pipe bore.

Referring to FIG. 5, there is shown in exaggerated detail a pipe 2 having a small internal bore 2*a*, a larger internal bore 2*b* and a shoulder 2*c* forming a transition between bores 2*a* and 2*b*. As the skids 10 are pulled through the small bore 2*a* and pass the shoulder 2*c*, they are free to deflect outwardly as indicated in FIG. 5 because of the non-pivoted, sliding connection of one end of each of the links 21 and 22 relative to the skids 10. Thus the skids 10 automatically move outwardly to pass by the shoulder 2*c* without in any manner disturbing the concentric alignment of the axis of the support saddle 25 with the axis of the pipe bore. It will be apparent that the skids could similarly deflect past a shoulder facing in the other direction, as one formed by the constriction at the end of a typical drill pipe. In such a situation, the leading ends of the skids 10 would be depressed by the shoulder, thus deflecting the skids inwardly while maintaining the axial alignment of the saddle 25 with the axis of the pipe bore.

From the aforegoing description, it will be apparent that this invention provides a simple, yet unusually reliable centralizing mechanism for automatically positioning the tubular element of a coating lance in coaxial alignment with the bore of a pipe or similar conduit to be coated. Movement of the centralizing mechanism in one direction through the pipe, as a preliminary to the coating operation causes the skids 10 to automatically collapse and freely pass through the pipe. Upon reverse movement of the tubular element 1 of the coating lance, the skids 10 are automatically expanded to snugly engage the interior bore surface of the pipe to be coated and to conform thereto as the lance is pulled through the pipe to accomplish the coating operation. Variations in internal diameter of the pipe are automatically followed by the skids 10 without disturbing the coaxial alignment of the support saddle 25 with the axis of the pipe bore.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A centralizing apparatus for a coating lance having an elongated tubular element movable coaxially through the bore of a pipe to be coated, comprising, in combination: a pair of elongated skids of arcuate cross section, the external surfaces of said skids being contoured to slidably engage the pipe bore; vertically expansible linkage means interconnecting said skids for moving said skids from a collapsed position adjacent to said tubular element to an expanded position in engagement with the pipe bore; means connected to said linkage means for supporting the tubular element in a central position relative to said skids; and a pair of actuating means secured to said tubular element on opposite sides of said linkage means, one of said actuating means being operable by movement of said tubular element in one axial direction to shift the linkage to its skid expanded position, and the other said actuating means being operable by movement of said tubular element in the other axial direction to shift said linkage means to its skid collapsed position, said linkage means comprising a pair of X-shaped links having a medial pivot pin, said means for supporting said tubular element comprising a saddle suspended between said pivot pins.

2. A centralizing apparatus for a coating lance having an elongated tubular element movable coaxially through the bore of a pipe to be coated, comprising, in combination: a saddle for supporting said tubular element; radially projecting horizontal pins on opposite sides of said saddle; a pair of links pivotally mounted on each pin with said links being vertically disposed and medially pivoted on the respective pins to form an X-shaped support linkage on each side of said saddle; a pair of elongated skids of arcuate cross-section, the external surfaces of such skids being contoured to slidably engage the pipe bore; means for horizontally pivotally mounting one end of each said link to one of said skids; means permitting the other ends of said links to slide relative to said skids, whereby displacement of said X-shaped linkages from a generally horizontal closed position to a more upright open position causes said skids to move from a collapsed position adjacent said tubular element to an expanded position engaging the pipe bore; and a pair of actuating means secured to said tubular element on opposite sides of said saddle, one of said actuating means being operable by movement of said tubular element in one axial direction to close the X-shaped linkages, and the other said actuating means being operable by movement of said tubular element in the other axial direction to open the X-shaped linkages and expand said skids into engagement with the pipe bore.

3. The centralizing apparatus defined in claim 2 wherein said one actuating means comprises a collar secured to said tubular element and engageable with said saddle, and the other said actuating means comprises a collar having integral, laterally spaced projections thereon respectively engageable with said X-shaped linkages.

4. A centralizing apparatus in accordance with claim 2 further comprising resilient means engageable with the said other ends of said links to impart a biasing force thereto urging said X-shaped linkages to said upright open position.

5. The centralizing apparatus of claim 4 further comprising means for adjusting the amount of said biasing force.

6. A centralizing apparatus for a coating lance having an elongated tubular element movable coaxially through the bore of a pipe to be coated, comprising, in combination: a saddle for supporting said tubular element; radially projecting horizontal pins on opposite sides of said saddle; a pair of links pivotally mounted on each said pin, with said links being vertically disposed and medially pivoted on the respective pins to define an X-shaped support linkage on each side of said saddle; a pair of elongated skids of arcuate cross section, the external surfaces of said skids being contoured to slidably engage the pipe bore; a bracket rigidly secured to the internal surface of each skid; means for horizontally pivotally mounting one end of each said link to one end of said bracket; means at the other ends of said links having slidable engagement with said bracket, whereby displacement of said X-shaped linkages from a generally horizontal closed position to a more upright open position causes said skids to move from a collapsed position adjacent said tubular element to an expanded position engaging the pipe bore; and a pair of actuating means secured to said tubular element on opposite sides of said saddle, one of said actuating means being operable by movement of said tubular element in one axial direction to close the X-shaped linkages, and the other said actuating means being operable by movement of said tubular element in the other axial direction to open the X-shaped linkages and expand said skids into sliding engagement with the pipe bore, said skids being depressible by engagement with any internal constriction in the pipe bore by virtue of the sliding engagement between said other ends of the links and said brackets.

7. The centralizing apparatus defined in claim 6 wherein said one actuating means comprises a collar secured to said tubular element and engageable with said saddle, and the other said actuating means comprises a collar having integral, laterally spaced projections thereon respectively engageable with said X-shaped linkages.

* * * * *